United States Patent [19]

Lasater

[11] 4,003,415

[45] Jan. 18, 1977

[54] LIQUID DISPENSING NOZZLE HAVING VAPOR RECOVERY AND SEALING ARRANGEMENT

[75] Inventor: Donald A. Lasater, Fairfield, Ohio

[73] Assignee: Dover Corporation, New York, N.Y.

[22] Filed: May 29, 1975

[21] Appl. No.: 581,718

[52] U.S. Cl. ..... 141/59; 141/392; 141/225

[51] Int. Cl.[2] ..... B67C 3/34; B65B 31/06

[58] Field of Search ..... 141/59, 97, 198–229, 141/46, 287, 392, 289, 301, 302; 277/30; 285/226; 403/50, 51

[56] References Cited

UNITED STATES PATENTS 3,866,636 2/1975 Lasater ..... 141/59

*Primary Examiner*—Houston S. Bell
*Attorney, Agent, or Firm*—John G. Schenk

[57] ABSTRACT

A liquid dispensing nozzle has a bellows secured to its body and disposed in spaced surrounding relation to its spout to form vapor return means therebetween. Sealing means, which can be integral with the bellows or separate therefrom, is disposed in surrounding relation to the spout so as to be movable relative thereto. The spout has a retainer thereon between the free end of the spout and the sealing means. The retainer has a curved surface, which is preferably spherical, on its end for engagement with a sealing surface of the sealing eans to form a seal therebetween to seal the vapor return means formed between the bellows and the spout from the atmosphere when the spout is not disposed in a fill pipe of a vehicle tank to be filled. When the spout is disposed in the fill pipe opening of the tank to be filled, the sealing surface of the sealing means engages the fill pipe to seal the fill pipe opening so that the vapors escape from the tank to the vapor return means formed between the bellows and the spout and from there to a vapor recovery passage in the nozzle body.

30 Claims, 9 Drawing Figures

LIQUID DISPENSING NOZZLE HAVING VAPOR RECOVERY AND SEALING ARRANGEMENT

When filling a vehicle tank with gasoline through a dispensing nozzle, vapors from the gasoline within the tank escape therefrom through the opening of the fill pipe in which the spout of the nozzle is inserted. This escape of the vapors into the atmosphere pollutes the air.

In U.S. Pat. No. 3,866,636 to Lasater, it has been suggested to provide a gasoline dispensing nozzle with a vapor recovery passage and a sealing arrangement between the fill pipe of the tank being filled and the vapor recovery passage of the nozzle. The sealing arrangement of the aforesaid Lasater patent also seals the vapor recovery passage when the tank is not being filled.

The present invention is an improvement of the aforesaid Lasater patent in that there can be certain conditions in which sealing of the vapor recovery passage is not maintained when the spout is not disposed in the fill pipe. This occurs when the seal is disposed so that its sealing surface, which cooperates with a conical surface on a retainer or stop on the spout, is disposed at an angle other than perpendicular to the longitudinal axis of the spout. This occurs because of the sealing means having the sealing surface capable of movement relative to the spout. While this amount of leakage is small, it is desired to be able to seal the vapor recovery or return passge irrespective of the position of sealing surface of the sealing means relative to the longitudinal axis of the spout.

The present invention solves this problem through forming the sealing surface on the retainer on the spout as a curved surface, which is preferably spherical. Accordingly, when using the curved surface on the retainer of the present invention, it is immaterial as to the angle of the sealing surface of the sealing means relative to the longitudinal axis of the spout.

It should be understood that the curved surface must be such than any section through the curved surface produces a curve at the boundary of the section rather than a straight line at the boundary of the section as occurs from a section through a conical surface.

The present invention also contemplates forming the portion of the sealing surface of the sealing means engaging the curved surface of the retainer as a curved surface, which is preferably spherical, and preferably having the same radius as the curved sealing surface of the retainer so as to be complementary thereto. In this arrangement, the remainder of the sealing surface of the sealing means is flat to sealingly engage around the fill pipe opening by engaging a flat surface of the fill pipe.

When inserting the spout of the nozzle in the fill pipe opening, it is desired in some uses to be able to lock the spout in the fill pipe opening. For example, this would enable the service station attendant to perform other functions while the tank is being filled automatically. With the retainer, which also is used to lock the spout in the fill pipe in addition to sealing the vapor recovery passage when the spout is not in the fill pipe, having only a curved surface, this curved surface does not necessarily have good locking engagement with the fill pipe.

The present invention satisfactorily improves the ability to lockably engage with the fill pipe by providing the surface of the retainer having the curved sealing surface with an inner surface, which is inside of the curved sealing surface and is suitable for retaining the nozzle within the fill pipe.

This inner surface, which must be noncontinuation of the curved sealing surface, can extend completely around the spout if desired although only a portion thereof may be necessary, depending on the angle of the fill pipe, to provide the desired latching of the spout within the fill pipe.

An object of this invention is to provide an improved sealing arrangement for a liquid dispensing nozzle having a vapor recovery system.

Other objects, uses, and advantages of this invention are apparent upon a reading of this description, which proceeds with reference to the drawings forming part thereof and wherein.

Figure 1:
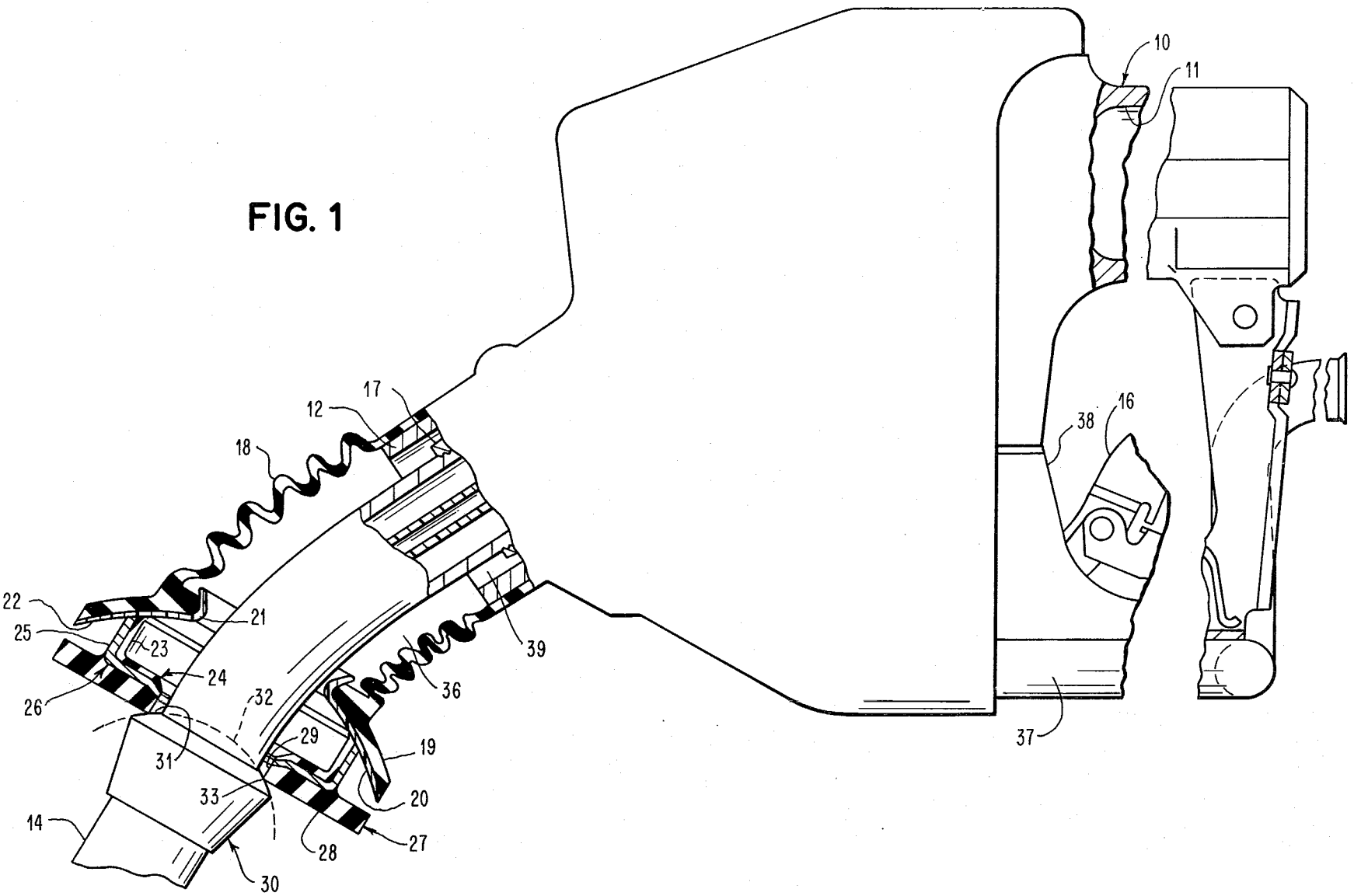
FIG. 1 is a sectional view, partly in elevation, of a nozzle having one form of the sealing arrangement of the present invention.

Referring to the drawings and particularly FIG. 1, there is shown a liquid dispensing nozzle of the type more particularly shown and described in U.S. Pat. No. 3,823,752 to Lasater et al. The liquid dispensing nozzle includes a nozzle body 10 having an inlet 11 to which a hose is connected to supply liquid such as gasoline, for example, to the interior of the body 10. The body 10 has an outlet 12 with which a spout 14 communicates to receive liquid from th interior of the body 10.

As specifically described in the aforesaid Lasater et al patent, the body 10 has a first or main poppet valve, which is controlled by a manually operated lever or handle 16, and a second poppet valve within the body 10 and spaced from the first poppet valve in the direction of flow of the liquid through the body 10. The poppet valves control the flow to the spout 14.

A spout adapter 17 is fixed to the body 10 by a screw, as more particularly shown and described in the aforesaid Lasater patent. The outlet 12 of the body 10 has one end of a bellows 18, which is preferably formed of gasoline resistant synthetic rubber, extending thereover and around portions of the body 10 to be retained thereon by suitable means such as an adhesive, for example.

The other end of the bellows 18 has a member 19, which is preferably formed of a gasoline resistant elastomer such as synthetic rubber, for example, connected thereto. The bellows 18 and the member 19 are preferably formed by being molded as a single piece.

The member 19 has a member 20, which is plastic such as Delrin, for example, secured thereto so as to be integral therewith. The member 20 has an opening 21 formed in the center thereof to enable the member 20 to slide along the spout 14.

The member 20 has its surface 22 formed as a sector of a sphere so that a cylindrical extension 23 of a member 24, which is preferably formed of the same material as the member 19, engages the surface 22 irrespective of the position of the member 24 on the spout 14. The member 24 has its cylindrical extension 23 supported by a cylindrical extension 25 of a plate 26, which is preferably formed of a suitable metal such as stainless steel, for example. The member 24 is secured to the plate 26, and the cylindrical extension 23 of the member 24 is secured to the cylindrical extension 25 of the plate 26 by a suitable adhesive.

The plate 26 has a disc 27, which is preferably integral with the member 24, secured thereto by a suitable adhesive. Thus, the member 24, the plate 26, and the disc 27 form a sealing member with the disc 27 having its flat surface 28 functioning as the sealing surface. The member 24, the plate 26, and the disc 27 have an opening 29 to enable them to be both slidably and rotatably mounted on the spout 14.

A retainer 30, which functions as a stop, is fixed to the spout 14 between the disc 27 and the free or discharge end of the spout 14 by suitable means such as a set screw or welding, for example. The retainer 30 has a surface 31 having an arcuate perimeter and preferably formed from a portion or sector of a sphere, which is shown in dotted lines at 32. Thus, the arcuate has an arcuate perimeter, and is preferably surface 31 of the retainer 30 also having an arcuate perimeter a spherical surface and is engaged by a corner edge 33 of the disc 27 to form an essentially leakproof seal therewith when the spout 14 is not inserted within the opening 34 (See FIG. 2) of a fill pipe 35 of a vehicle tank such as an automobile fuel tank, for example.

Accordingly, when the arcuate corner edge 33 of the disc 27 engages the spherical surface 31 of the retainer 30 and the cylindrical extension 23 of the member 24 engages the surface 22 of the member 20 as shown in FIG. 1, the space therebetween is sealed from the atmosphere. This sealed space communicates through the opening 21 in the member 20 with an annualar passage 36, which is formed between the bellows 18 and the spout 14 and forms part of the vapor recovery or return arrangement of the body 10. As more particularly shown and described in the aforesaid Lasater patent, the annular passage 36 communicates with a vapor recovery tube or hose 37, which is supported on a guard 38 secured to the body 10, as more particularly shown and described in U.S. Pat. No. 3,653,415 to Boudout et al through an annular passage 39, which is formed between the spout adapter 17 and the body 10. The vapor recovery tube 37 is connected by a suitable hose to vapor recovery equipment.

Accordingly, when the spout 14 is not inserted in the opening 34 of the fill pipe 35, the vapor recovery equipment is not connected to the atmosphere but is sealed through the cylindrical extension 23 of the member 24 engaging the surface 22 of the member 20 and the disc 27 having its arcuate corner edge 33 engage the arcuate perimeter of spherical surface 31 of the retainer 30. Thus, vapor cannot escape to the atmosphere when the spout 14 is withdrawn from the fill pipe 35.

Figure 3:
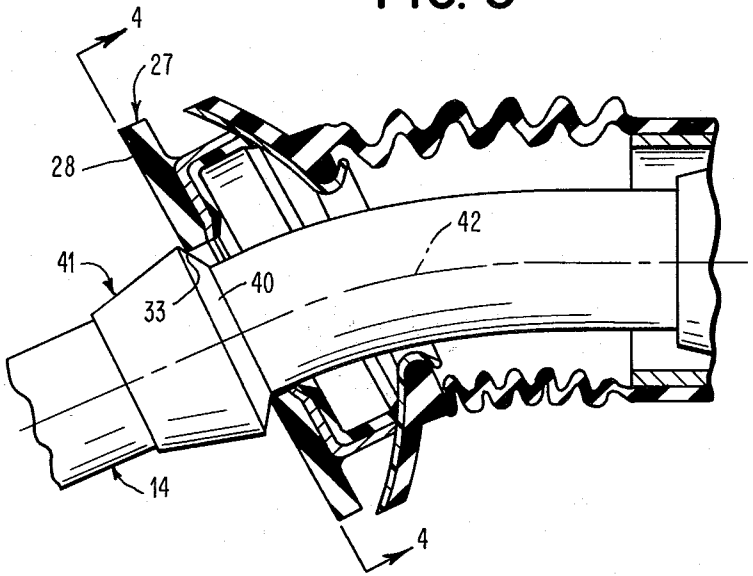
FIG. 3 is a fragmentary sectional view, partly in elevation, of the seal used with a retainer having a conical sealing surface and not having its flat surface perpendicular to the longitudinal axis of the spout.
Figure 4:
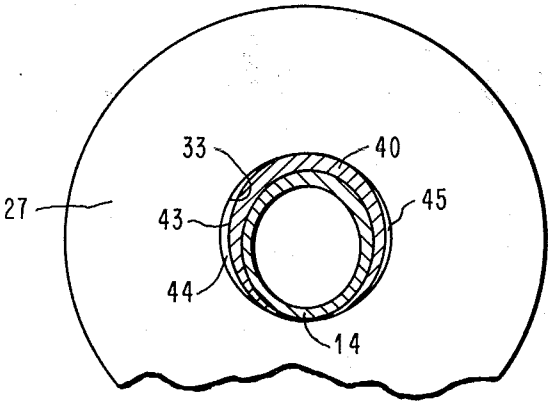
FIG. 4 is a sectional view taken along line 4—4 of FIG. 3.

As shown in FIGS. 3 and 4, the arcuate inner corner edge 33 of the disc 27 will not engage a conical surface 40 of a retainer 41 throughout 360° when the disc 27 has its flat surface 28 disposed other than perpendicular to longitudinal axis 42 of the spout 14. With the flat surface 28 of the disc 27 not disposed perpendicular to the longitudinal axis 42 of the spout 14 as shown in FIG. 3, the sectional area of the conical surface 40 of the retainer 41 has an elliptical outer periphery 43 (see FIG. 4) along the section line 4—4 of FIG. 3. Accordingly, leakage areas 44 and 45 are formed between the arcuate inner circular corner edge 33 of the disc 27 and the elliptical outer periphery 43 of the conical surface 40 of the retainer 41 when the flat surface 28 of the disc 27 is not perpendicular to the longitudinal axis 42 of the spout 14.

By having an arcuate perimeter which is complementary with the arcuate perimeter of edge 33, the spherical surface 31 of the retainer 30 of the present invention avoids this problem since the leakage areas 44 and 45 are not present irrespective of the angle of the flat surface 28 relative to the longitudinal axis 42 of the spout 14. This is because a section through a sphere produces a circle irrespective of the angle of the flat surface 28 relative to the longitudinal axis 42 of the spout 14. Such a circle is thus complementary with the arcuate shape of the perimeter of edge 33.

Figure 2:
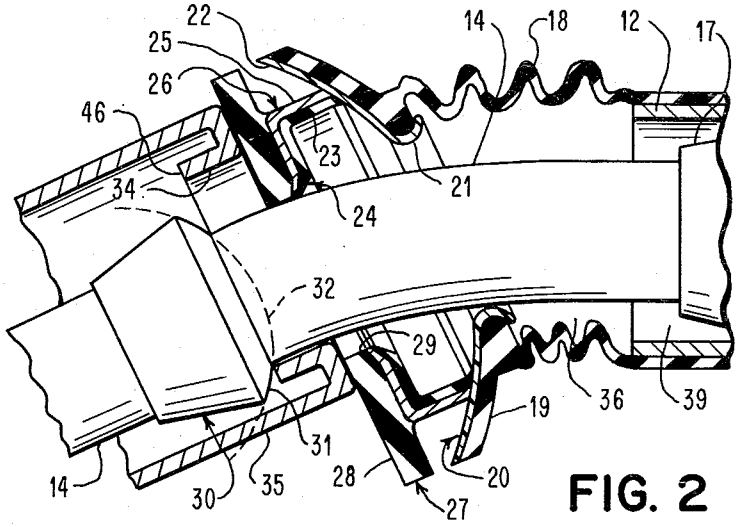
FIG. 2 is a fragmentary sectional view, partly in elevation, of the sealing arrangement of FIG. 1 with the spout of the nozzle disposed in the fill pipe of a vehicle tank to be filled.

When the spout 14 is inserted into the opening 34 of the fill pipe 35 as shown in FIG. 2, the flat surface 28 of the disc 27 abuts the end of the fill pipe 35 so as to not follow the movement of the spout 14 and the retainer 30 into the fill pipe opening 34. This results in the bellows 18, which continuously urges the member 20 toward the free end of the spout 14 so that the spherical surface 22 of the member 20 is always in engagement with the cylindrical extension 23 of the member 24 and the cylindrical extension 25 of the plate 26, being slightly compressed.

Accordingly, when the spout 14 is in the position of FIG. 2, vapors within the tank being filled can flow through the opening 34 of the fill pipe 35, the opening 29, and the opening 21 into the annular passage 36 from which they flow through the annular passage 39 to the vapor recovery or return tube 37. Thus, the movement of the spout 14 into the opening 34 for the fill pipe 35 results in the seal between the disc 27 and the retainer 30 being broken whereby the vapors can be removed from the tank being filled.

With the surface 31 of the retainer 30 being spherical, the retainer 30 cannot always be locked within the fill pipe 35 through cooperation of the retainer 30 with a lip 46 of the fill pipe 35. Since it is only necessary that there be sufficient insertion of the spout 14 into the opening 34 of the fill pipe 35 for the seal between the disc 27 and the retainer 30 to be broken and sufficient force to hold the flat surface 28 of the disc 27 in sealing engagement with a surface of the fill pipe 35 around the opening 34, it is not necessary for there to be locking of the spout 14 to the fill pipe 35.

However, if it is desired to always lock the spout 14 to the fill pipe 35, a retainer 47 (see FIG. 8) can be substituted for the retainer 30 of FIG. 1. In this arrangement, the retainer 47 has an outer surface 48 formed from a sector or portion of a sphere, which is shown in dotted lines at 49, and a flat centrally located, or inner surface 50.

It should be understood that the arcuate inner corner edge 33 of the disc 27 must have its diameter selected so that the inner corner edge 33 will always remain in engagement with the arcuate perimeter of outer spherical surface 48 of the retainer 47 irrespective of the angular relation of the flat surface 28 of the disc 27 to the longitudinal axis 42 of the spout 14.

Figure 8:
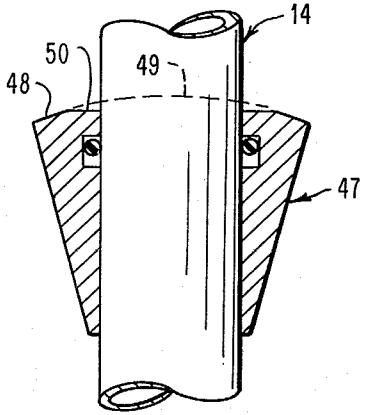
FIG. 8 is a fragmentary sectional view, partly in elevation, of another form of the retainer mounted on the spout and capable of locking the spout to the fill pipe.

As shown in FIG. 8, the flat central, or inner surface extends 360° around the spout 14 so as to be an inner surface. With this arrangement, the spout 14 is locked to the fill pipe 35 by engagement of the flat surface 50 of the retainer 47 with the lip 46 of the fill pipe 35 to insure that the seal between the retainer 30 and the disc 27 is broken and vapor can flow from the tank to the vapor recovery or return tube 37.

The outer spherical surface 48, which is annular, still cooperates with the arcuate inner corner edge 33 of the disc 27 to form a seal therebetween when the spout 14 is not disposed within the fill pipe opening 34. Thus, the retainer 47 of FIG. 8 provides both locking and sealing.

If desired, a retainer 51 (see FIG. 9) could be employed rather than the retainer 47. The retainer 51 has the outer spherical surface 48 having an arcuate perimeter in the same manner as the retainer 47. However, the retainer 51 has a centrally located or inner flat surface 52, which extends for less than 360°. The inner flat surface 52 can extend for any number of degrees, as desired, less than 360° as long as it is capable of engaging the lip 46 of the fill pipe 35. Of course, the outer spherical surface 48 extends to the surface of the spout 14 wherever the inner surface 52 is not present.

To disconnect the spout 14 from the fill pipe 35 when the retainer 47 or 51 is used, it is only necessary to slightly move the spout 14 within the fill pipe 35 so that the flat surface 50 of the retainer 47 or the flat surface 52 of the retainer 51 is no longer engaged by the lip 46 of the fill pipe 35. When withdrawal of the retainer 30, 47, or 51 from the fill pipe 35 is initiated irrespective of whether the retainer 30, 47, or 51 is utilized, the spherical surface 31 of the retainer 30 or the spherical surface 48 of the retainer 47 or 51 is engaged by the disc 27 due to the force of the bellows 18 urging the member 20 towards the discharge or free end of the spout 14. As a result, the seal again exists between the retainer 30, 47, or 51 and the disc 27 whereby the vapor recovery or return system is not exposed to the atmosphere. Because of the surface 31 of the retainer 30 or the surface 48 of the retainer 47 or 51 having an arcuate perimeter by being formed as a sector or portion of a sphere, the circular corner edge 33 of the disc 27 always engages the arcuate surface 31 of the retainer 30 or the surface 48 of the retainer 47 or 51 irrespective of the relationship of the end face 28 to the longitudinal axis 42 of the spout 14.

Figure 5:
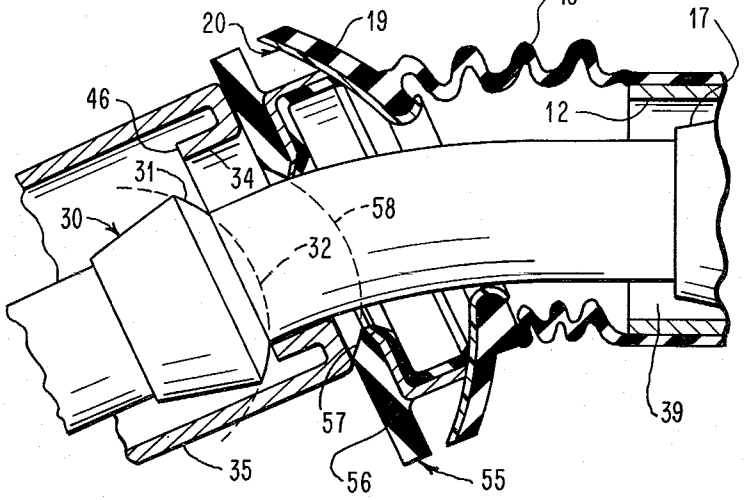
FIG. 5 is a fragmentary sectional view, partly in elevation, of another form of the sealing surface used with the nozzle of FIG. 1 and showing the spout of the nozzle disposed in the fill pipe.

Referring to FIG. 5, there is shown another form of the sealing arrangement of the present invention utilized with the nozzle body 10 of FIG. 1. In this modification, the disc 27 has been replaced by a disc 55. The disc 55 has its sealing surface formed of an arcuate outer portion 56, which is flat, and a centrally located, or inner portion 57, which has a surface which is curved away from the plane of flat portion 56 to be complementary to the surface 31 of the retainer 30. Thus, the inner surface portion 57 is formed from a sector or portion of a sphere 58 preferably having the same radius as the sphere 32 so that the surface 31 of the retainer 30 and the inner surface portion 57 of the disc 55 are complementary sealing surfaces.

The outer sealing surface portion 56 of the disc 55 engages the end of the fill pipe 35 so as to not follow the movement of the spout 14 and the retainer 30 into the fill pipe opening 34 when the spout 14 is inserted into the opening 34 of the fill pipe 35. Thus, this arrangement provides complementary sealing surfaces to prevent the vapor recovery or return system from being exposed to the atmosphere.

Figure 6:
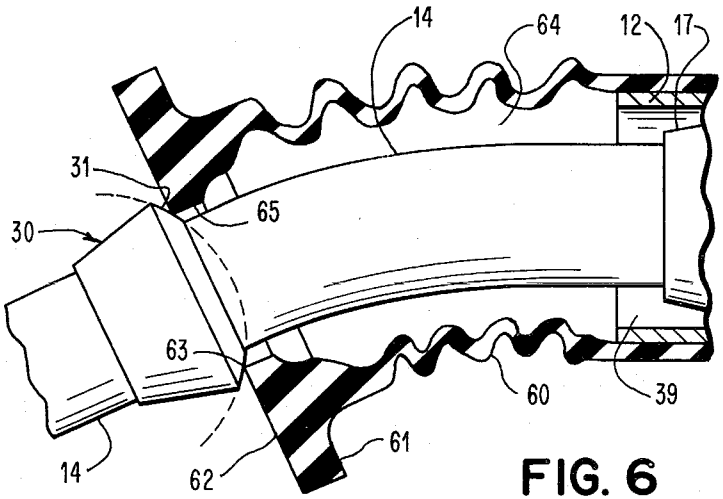
FIG. 6 is a fragmentary sectional view, partly in elevation, of another type of seal used with the retainer of FIG. 1.

Referring to FIG. 6, there is shown another form of the sealing arrangement of the present invention utilized with the nozzle body of FIG. 1. The sealing arrangement includes a bellows 60, which may be formed of the same material as the bellows 18, for example. The bellows 60 is secured to the outlet 12 of the body 10 in the same manner as the bellows 18.

The bellows has a sealing member 61 formed integral therewith. The sealing member 61 has a flat sealing surface 62 for engagement with the end of the fill pipe 35 when the spout 14 is inserted into the fill pipe opening 34 and for engagement with the spherical surface 31 of the retainer 30 when the spout 14 is not inserted into the fill pipe opening 35. The flat sealing surface 62 has a circular corner edge 63 engaging the spherical sealing surface 31 of the retainer 30 to form the seal therebetween.

When the corner edge 63 of the sealing surface 62 engages the spherical surface 31 of the retainer 30, an annular passage 64, which is formed between the bellows 60 and the spout 14 and forms part of the vapor recovery or return arrangement of the body 10, is sealed since an opening 65, which is formed within the sealing member 61 and communicates with the annular passage 64, is sealed by the spherical sealing surface 31 of the retainer 30 engaging the edge 63 of the sealing member 61. Accordingly, when the spout 14 is not inserted into the opening 34 of the fill pipe 35, the vapor recovery equipment is not connected to the atmosphere but is sealed by the spherical surface 31 of the retainer 30 engaging the inner circular corner edge 63 of the flat sealing surface 62 of the sealing member 61.

When the spout 14 is inserted into the fill pipe opening 34, the flat surface 62 of the sealing member 61 abuts the end of the fill pipe 35 so as to not follow the movement of the spout 14 and the retainer 30 into the fill pipe opening 34. This results in the bellows 60, which continuously urges the sealing member 61 toward the discharge or free end of the spout 14, being slightly compressed. Therefore, when the spout 14 is inserted within the fill pipe opening 34, the vapor within the tank can flow through the fill pipe opening 34 and the opening 65 to the annular passage 64 from which it flows through the annular passage 39 to the vapor recovery tube 37.

Figure 9:
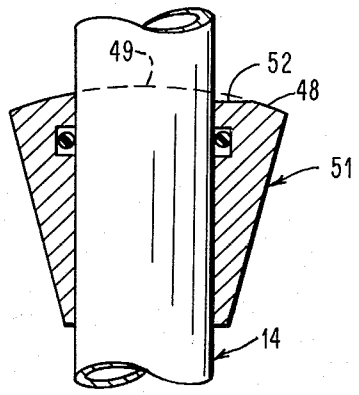
FIG. 9 is a fragmentary sectional view, partly in elevation, of a further embodiment of the retainer mounted on the spout and capable of locking the spout to the fill pipe.

It should be understood that the retainer 47 of FIG. 8 or the retainer 51 of FIG. 9 could be utilized instead of the retainer 30 with this embodiment if desired. This would enable locking of the spout 14 to the fill pipe 35.

Figure 7:
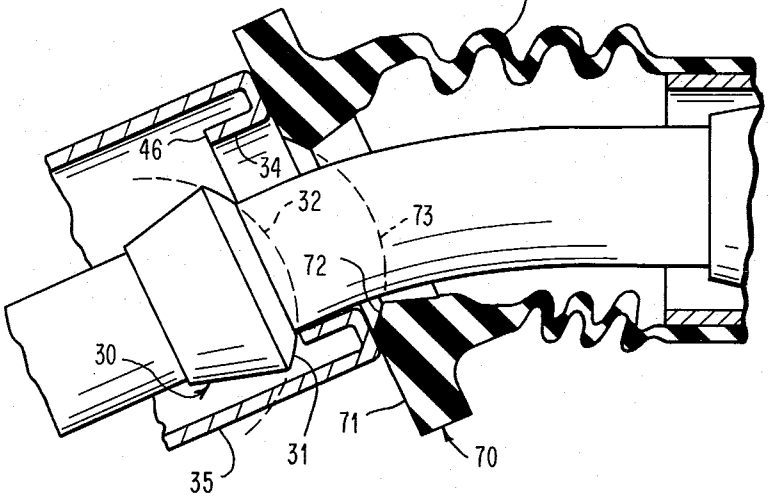
FIG. 7 is a fragmentary sectional view, partly in elevation, of a modification of the seal of FIG. 6 and showing the spout of the nozzle disposed in the fill pipe.

Referring to FIG. 7, there is shown a sealing arrangement similar to that of FIG. 6. The bellows 60 has a sealing member 70 formed integrally therewith in the same manner as the sealing member 61. The sealing member 70 has a flat outer sealing surface 71 for engagement with the end of the fill pipe 35 when the spout 14 is inserted into the fill pipe opening 34. The sealing member 70 has an inner sealing surface 72, which is curved away from the plane having surface 71 therein and is preferably formed from a portion or sector of a sphere 73 preferably having the same radius as the sphere 32 from which the sealing member 700 and the retainer 30 is formed. Thus, the sealing member 70 and the retainer 30 have complementary curved sealing surfaces when the spout 14 is not disposed in the fill pipe opening 34. This prevents the vapor recovery system from communicating with the atmosphere.

It should be understood that the curved surface of the retainer 30, 47, or 51 could be formed form other than a sector or portion of a sphere because of the relatively small amount of curved surface utilized. It is only necessary that the sealing surface 31 of the retainer 30 or the sealing surface 48 of the retainer 47 always engage the sealing surface with which it cooperates irrespective of the angular relation of the engaged sealing surface to the longitudinal axis 42 of the spout 14. However, when the curved surface is formed from a sector or portion of a sphere, the optimum results are obtained.

It should be understood that the retainers 47 and 51 can be readily utilized with the embodiment of FIG. 7 if desired. The retainers 47 and 51 are employed when it is desired to always lock the spout 14 within the fill pipe 35.

An advantage of this invention is that positive sealing of a vapor recovery system is obtained. Another advantage of this invention is that the sealing arrangement can be utilized with various types of liquid dispensing nozzles.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A liquid dispensing nozzle having a body, a spout extending from said body and having its free end for disposition in an opening of a fill pipe of a vehicle tank or the like, means to return vapor from the tank being filled, said vapor return means having sealing means associated therewith to form a seal between the fill pipe opening and said vapor return means when said spout is disposed in the fill pipe, said sealing means having a sealing edge thereon, said sealing edge having an arcuate perimeter, means continuously urging said sealing means toward the free end of said spout, said spout having means disposed thereon between the free end of said spout and said sealing edge of said sealing means, said disposed means having a sealing edge engaging surface on its end adjacent said sealing edge of said sealing means, said sealing edge engaging surface having a section which is curved to have an arcuate perimeter complementary to the arcuate perimeter of said sealing edge and located on said disposed means to engage said sealing edge of said sealing means over essentially the entire perimeter of said sealing edge irrespective of the angular relation of said sealing edge of said sealing means to the longitudinal axis of said spout to form an essentially leakproof seal therebetween when said spout is not disposed in the fill pipe to seal said vapor return means from the atmosphere, and said sealing edge of said sealing means being removed from engagement with said curved sealing edge engaging surface of said disposed means while remaining in sealing engagement with a surface around the fill pipe opening when said spout is inserted in the fill pipe by compression of said urging means to cause communication between said vapor return means and the tank being filled.

2. The nozzle according to claim 1 in which said disposed means has a surface formed on its end adjacent said sealing edge of said sealing means and centrally disposed of said curved section of said disposed means to engage a portion of the fill pipe to lock said spout to the fill pipe when said spout is disposed in the fill pipe and inside surface being a non-continuation of said curved section of said disposed means.

3. The nozzle according to claim 2 in which said sealing surface of said sealing means is flat and engages both said curved section of said disposed means and a surface around the fill pipe opening.

4. The nozzle according to claim 3 including bellows disposed in surrounding and spaced relation to form a portion of said vapor return means between said spout and said bellows, said bellows having one end connected to said body, said bellows having its other end associated with said sealing means, and said bellows comprising said urging means.

5. The nozzle according to claim 4 in which said sealing means is integral with said bellows and is at the other end thereof.

6. The nozzle according to claim 4 in which said sealing means is separate from said bellows and mounted for sliding movement along said spout.

7. The nozzle according to claim 4 in which said curved surface of said disposed means is a sector of a sphere.

8. The nozzle according to claim 3 in which said curved surface of said disposed means is a sector of a sphere.

9. The nozzle according to claim 2 in which said edge of said sealing means is part of a sealing surface which includes inner and outer annular portions, said outer portion being flat to engage a surface around the fill pipe opening, and said inner portion being curved to engage said curved section of said disposed means in a complementary relation.

10. The nozzle according to claim 9 including bellows disposed in surrounding and spaced relation to form a portion of said vapor return means between said spout and said bellows, said bellows having one end connected to said body, said bellows having its other end associated with said sealing means, and said bellows comprising said urging means.

11. The nozzle according to claim 10 in which said sealing means is integral with said bellows and is at the other end thereof.

12. The nozzle according to claim 10 in which said sealing means is separate from said bellows and mounted for sliding movement along said spout.

13. The nozzle according to claim 10 in which each of said curved surface of said disposed means and said inner portion of said sealing surface of said sealing means is a sector of spherical surface.

14. The nozzle according to claim 9 in which each of said curved surface of said disposed means and said inner portion of said sealing surface of said sealing means is a spherical sealing surface.

15. The nozzle according to claim 2 in which said curved surface of said disposed means is a sector of a spherical surface.

16. The nozzle according to claim 2 in which said centrally disposed surface of said disposed means extends for less than 360°.

17. The nozzle according to claim 2 in which said centrally disposed surface of said disposed means extends for 360°.

18. The nozzle according to claim 1 in which said sealing edge of said sealing means is flat and engages both said curved surface of said disposed means and a surface around the fill pipe opening.

19. The nozzle according to claim 18 including bellows disposed in surrounding and spaced relation to form a portion of said vapor return means between said spout and said bellows, said bellows having one end connected to said body, said bellows having its other end associated with said sealing means, and said bellows comprising said urging means.

20. The nozzle according to claim 19 in which said sealing means is integral said bellows and is at the other end thereof.

21. The nozzle according to claim 19 in which said sealing means is separate from said bellows and mounted for sliding movement along said spout.

22. The nozzle according to claim 19 in which said curved surface of said disposed means is a sector of a spherical surface.

23. The nozzle according to claim 18 in which said curved surface of said disposed means is a sector of a spherical surface.

24. The nozzle according to claim 1 in which said sealing edge of said sealing means is part of a sealing surface which includes inner and outer annular portions, said outer portion being flat to engage a surface around the fill pipe opening, and said inner portion being curved to engage said curved surface of said disposed means in a complementary relation.

25. The nozzle according to claim 24 including bellows disposed in surrounding and spaced relation to form a portion of said vapor return means between said spout and said bellows, said bellows having one end connected to said body, said bellows having its other end associated with said sealing means, and said bellows comprising said urging means.

26. The nozzle according to claim 25 in which said sealing means is integral with said bellows and is at the other end thereof.

27. The nozzle according to claim 25 in which said sealing means is separate from said bellows and mounted for sliding movement along said spout.

28. The nozzle according to claim 25 in which each of said curved surface of said disposed means and said inner portion of said sealing surface of said sealing means is a sector of a spherical sealing surface.

29. The nozzle according to claim 24 in which each of said curved surface of said disposed means and said inner portion of said sealing surface of said sealing means is a sector of a spherical sealing surface.

30. The nozzle according to claim 1 in which said curved surface of said disposed means is a sector of a spherical sealing surface.

* * * * *